US008221099B2

(12) United States Patent
Binfet et al.

(10) Patent No.: US 8,221,099 B2
(45) Date of Patent: Jul. 17, 2012

(54) WINDSHIELD WASHER PUMP WITH BREATHER HOLE COVER

(75) Inventors: Michael Binfet, Raymond, OH (US); David Rose, Raymond, OH (US)

(73) Assignee: Honda Motor Co. Ltd., Tokyo (JP)

( * ) Notice: Subject to any disclaimer, the term of this patent is extended or adjusted under 35 U.S.C. 154(b) by 989 days.

(21) Appl. No.: 12/059,219

(22) Filed: Mar. 31, 2008

(65) Prior Publication Data

US 2009/0246046 A1 Oct. 1, 2009

(51) Int. Cl.
*F04B 17/00* (2006.01)

(52) U.S. Cl. ..... 417/493; 134/198; 310/89

(58) Field of Classification Search ..... 134/198; 310/75 R, 88, 89; 417/360, 366, 393, 423.1, 417/423.15

See application file for complete search history.

(56) References Cited

U.S. PATENT DOCUMENTS 2,465,042 A * 3/1949 Schlenker et al. ..... 310/89
3,021,442 A 2/1962 Rodak
4,544,166 A 10/1985 Karasawa
4,720,648 A 1/1988 DeVries et al.
4,893,039 A 1/1990 Isii
5,045,736 A * 9/1991 Amano et al. ..... 310/88
5,650,677 A 7/1997 Furukawa et al.
6,053,708 A 4/2000 Nishikawa
6,254,360 B1 * 7/2001 Sato ..... 417/366
6,782,879 B2 8/2004 Duda et al.
2007/0295160 A1 * 12/2007 Mizutani ..... 74/606 R

FOREIGN PATENT DOCUMENTS

GB 2276987 A * 10/1994

* cited by examiner

*Primary Examiner* — Michael Barr
*Assistant Examiner* — Benjamin Osterhout
(74) *Attorney, Agent, or Firm* — Mark E. Duell, Esq.; Emerson Thomson Bennett

(57) ABSTRACT

A fluid pump assembly is disclosed for performing in a damp environment. A pump member is provided that drives a quantity of fluid. A pump housing encloses the pump member and includes a breather hole for circulating cooling air around the pump member during operation. A cover is provided that substantially covers the breather hole and defines a tortuous path that enables air to circulate through the breather hole while preventing entry of water thereto.

10 Claims, 3 Drawing Sheets

WINDSHIELD WASHER PUMP WITH BREATHER HOLE COVER

I. BACKGROUND OF THE INVENTION

A. Field of Invention

This invention generally relates to ventilation apparatuses and related structures and/or methods for electric motors, such as motors comprising a windshield washer pump.

B. Description of the Related Art

During operation, pump motors generate heat that must be dissipated to prevent a heat buildup that would interfere with pump operation. Thus, pumps are typically ventilated with a breather hole that allows air to circulate in and out of the pump during pump operation. However, problems are encountered with pumps that operate out of doors or in an otherwise damp environment since the breather hole can allow moisture to enter the pump housing, resulting in damage to the pump. Pumps included with a windshield washer system can get water inside from the ambient environment and also from the washer fluid itself, since fluid being pumped from the fluid reservoir can also enter the pump housing.

To avoid water and fluid entry, wiper washer pumps typically include a breather hole that follows some sort of circuitous path from the exterior surface of the pump to the interior of the housing. However, this winding path requires extensive design and tooling along with additional manufacturing steps so as to produce a finished part, thereby adding considerably to the complexity and expense to the finished part.

The present invention provides a pump system having a cover over the breather hole that shields moisture from the outside environment in a simple, uncomplicated design that is easily facilitated during the manufacturing process.

II. SUMMARY OF THE INVENTION

Some embodiments of the present invention generally relate to a fluid pump assembly for performing in a damp environment. A pump member is provided that drives a quantity of fluid. A pump housing encloses the pump member and includes a breather hole for circulating cooling air around the pump member during operation. A cover is provided that substantially covers the breather hole and defines a tortuous path that enables air to circulate through the breather hole while preventing entry of water thereto.

Other embodiments of the invention generally relate to a vehicle window washer system. A pump member drives a quantity of washer fluid from a fluid reservoir. A spray nozzle extends from the pump member and directs pumped washer fluid toward a window. A generally cylindrical pump housing encloses the pump member. The pump housing includes a breather hole for circulating cooling air around the pump member during operation. A generally cylindrical cover member substantially surrounds at least a portion of the pump housing so as to substantially cover the breather hole. Some of the cover member and the pump housing contact surfaces are substantially spaced so as to define a tortuous path that enables air to circulate through the breather hole while preventing entry of water thereto.

Still other embodiments of the invention generally relate to a fluid pump assembly for performing in a damp environment including means for driving a quantity of fluid. Means are provided for enclosing the means for driving comprising a means for circulating cooling air around means for driving during operation. Means are also provided for substantially covering the means for circulating and for defining a tortuous path that enables air to circulate while preventing entry of water thereto.

Other benefits and advantages will become apparent to those skilled in the art to which it pertains upon reading and understanding of the following detailed specification.

III. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

IV. DETAILED DESCRIPTION OF THE INVENTION

The present invention generally relates to a ventilation arrangement for electric motors, such as one or more breather holes. Other embodiments comprise structures and/or methods that relate to ventilation for electric motors. In some embodiments, the electric motor to which such structures and/or methods relate can be a component of a windshield washer pump.

According to one embodiment, a pump housing that encloses an electric motor includes a perforation and/or through-hole that provides a path for fluid communication between air on the inside of the housing and air on the outside of the housing. Some embodiments also include a cover member for covering the perforation and/or through-hole in which the cover member can be attached to the housing. A portion of the cover member is spaced apart from the housing and defines a gap between the housing and the cover member. The perforation or through-hole is located underneath or behind the cover member. Thus, in order to move fluid from the outside to the inside of the housing the fluid must follow a non-linear path and become trapped therebehind.

In some embodiments, the housing can comprise a cylinder having an outwardly-facing surface and an inwardly-facing surface. The inwardly-facing surface faces and/or encloses an electric motor. In some embodiments the cylinder can have one or more closed ends.

Figure 1A:
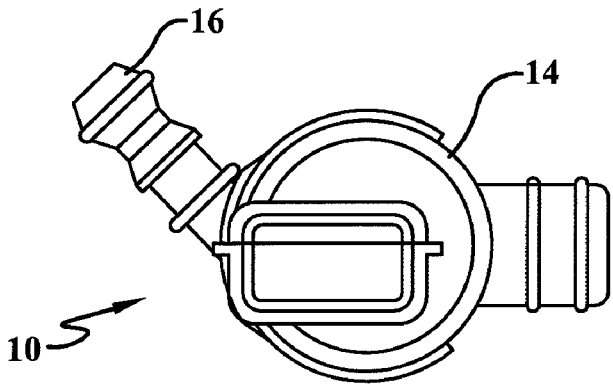
FIGS. 1A and 1B are respective top and side views of a pump system including a cover member in accordance with the present invention.
Figure 1B:
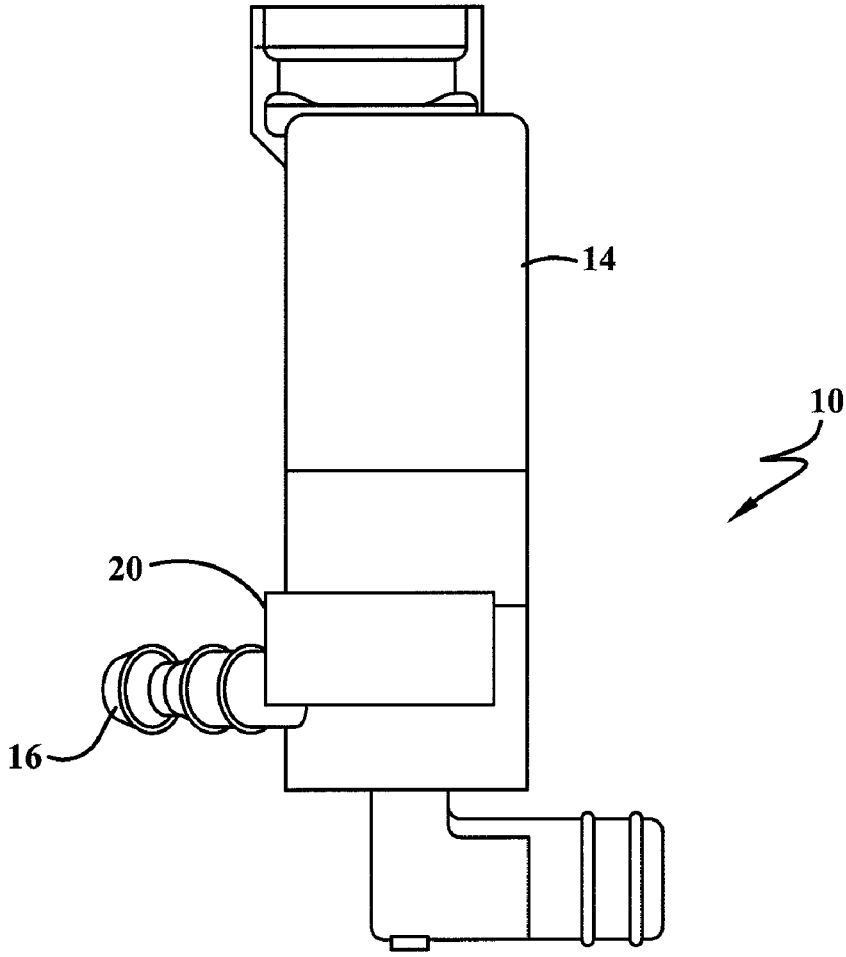

Referring now to the drawings wherein the showings are for purposes of illustrating embodiments of the invention only and not for purposes of limiting the same, and wherein like reference numerals refer to like elements, FIGS. 1A and 1B depict the exterior of a fluid pump assembly 10 specifically intended for performing in a damp environment. The present fluid pump assembly 10 preferably performs in an outside environment where rain and other water would be encountered that could enter the pump housing and damage the motor. Preferably, the fluid pump assembly 10 is a component in a vehicle window washer system.

Figure 2A:
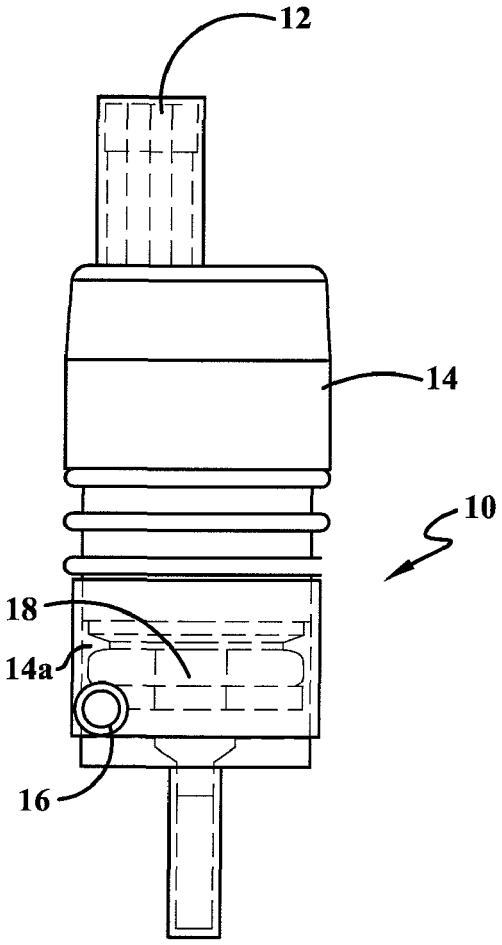
FIGS. 2A and 2B are respective first and second side-sectional views of a pump system including a cover member in accordance with an alternate embodiment of the present invention.
Figure 2B:
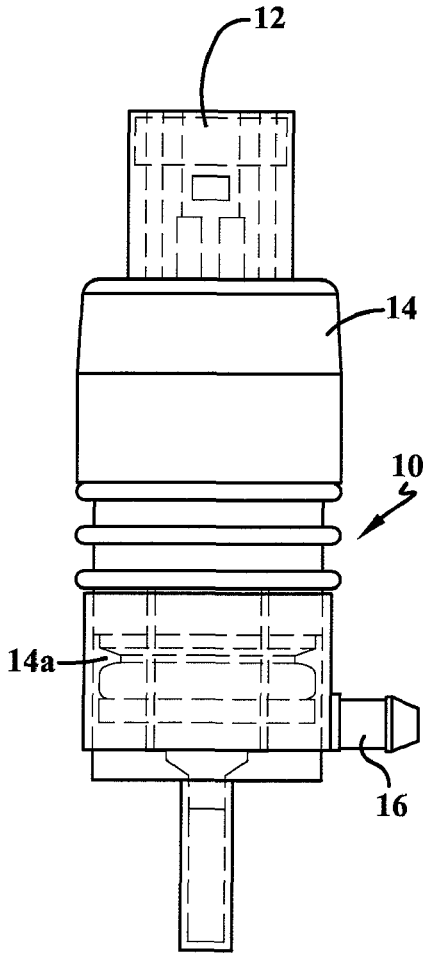

As especially shown in the side-sectional views of the embodiment of FIGS. 2A and 2B, a pump member 12 is provided that drives a quantity of fluid, preferably a quantity of washer fluid from a fluid reservoir in a motor vehicle. The pump member 12 can preferably be any suitable type of electric motor such as a 12 volt motor operated by a standard vehicle electrical system. However, it should be appreciated that any suitable type of motor can be used, such as a motor driven through a mechanical linkage or through hydraulic or pneumatic supply mechanisms.

As shown especially in FIGS. 1A, 1B, 2A, and 2B, a pump housing 14 is provided that encloses the pump member 12. In the preferred embodiment, the pump housing 14 is generally cylindrical, though any suitably shaped housing could be used without departing from the invention.

As also shown especially in FIGS. 1A, 1B, 2A, and 2B, for embodiments in which the present fluid pump assembly 10 is a component in a vehicle window washer system, a spray nozzle 16 is included that extends from the pump member 12 and directs pumped washer fluid toward a window. However, the present invention can also be used in pump systems that do not include a spray nozzle.

As best shown in FIG. 2A, the pump housing 14 includes a breather hole 18 for ventilating the pump member 12 by circulating cooling air around the pump member 12 during operation. The breather hole 18 is sufficient to allow a quantity of air to enter and exit the pump housing 14, driven by the motion of the motor within the pump housing 14. The breather hole 18 lies along the surface of the pump housing 14, and for a generally cylindrical pump housing 14 as mentioned above, the breather hole 18 lies along the cylindrical surface.

The breather hole 18 can include any number or size of suitably placed apertures or perforations so as to allow ingress and egress of air through the pump housing 14, as long as these apertures or perforations are located at positions on the pump housing 14 that enable them to be covered, as will be explained presently hereinbelow.

As shown in FIGS. 1A, 1B, 2A, and 2B, a cover member 20 is provided that substantially covers the breather hole 18. The cover member 20 defines a tortuous path with the pump housing 14 that enables air to circulate through the breather hole 18 while preventing entry of water thereto. As used herein, a "tortuous path" is intended to connote a winding or circuitous path for circulating ventilation air so as to enable fluid communication between the ambient environment and the interior of the pump housing 14, but of sufficient complexity that water is trapped before it can enter the pump housing 14.

The cover member 20 and the pump housing 14 have contact surfaces such that these elements are substantially spaced from each other so as to define the maze-like tortuous path. In this manner, the breather hole 18 is sufficiently exposed to the open air so as to enable air circulation while preventing entry of water thereto.

The cover member 20 is preferably substantially arcuate in shape so as to fit around an exterior portion of the generally cylindrical pump housing 14. In order to accommodate the cover member 20, the pump housing 14 has an outer diameter that is less than an inner diameter of the cover member 20, thereby allowing the two parts to fits snugly together.

Figure 3A:
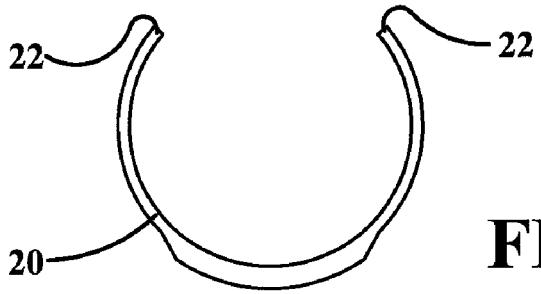
FIGS. 3A and 3B are top views respectively of first and second embodiments of a cover member for a pump system, in accordance with the present invention.

FIG. 3A illustrates an embodiment of the cover member 20 used in conjunction with the embodiment of the pump system 10 as depicted in FIGS. 1A and 1B. The cover member 20 of this embodiment is defined by an arc subtending less than 360 degrees around the pump housing 14. The cover member 20 can have open ends 22 that are spaced apart. In this manner, the cover member 20 can be snap-fit around the pump housing 14 so that the open ends 22 securely engage the pump housing 14.

Figure 3B:
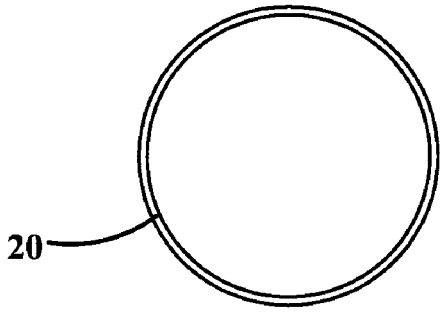

FIG. 3B illustrates an embodiment of the cover member 20 used in conjunction with the embodiment of the pump system 10 as depicted in FIGS. 2A and 2B. The cover member 20 of this embodiment is defined by an arc subtending a full 360 degrees. As a continuously circular piece, the cover member 20 can be slid around the pump housing 14 during assembly so as to be securely fastened to the pump housing 14.

The cover member 20 includes an interior mating surface that engages an exterior mating surface on the pump housing 14. While portions of these surfaces make contact with each other in order to hold the cover member 20 in place, some portions of the interior and exterior mating surfaces are substantially spaced so as to define the tortuous path that enables air to circulate through the breather hole while preventing entry of water thereto.

As especially shown in FIGS. 2A and 2B, the spaced portions of the interior and exterior mating surfaces are defined by a recess 14*a* formed onto the exterior surface of the pump housing 14. Along the surface area of the recess 14*a*, the pump housing 14 is substantially spaced from the interior mating surface of the cover member 14 so as to define the tortuous path. As shown in the aforementioned FIGURES, the recess 14*a* is substantially annular and defines a tapered portion of the exterior surface of the pump housing 14.

Figure 4A:
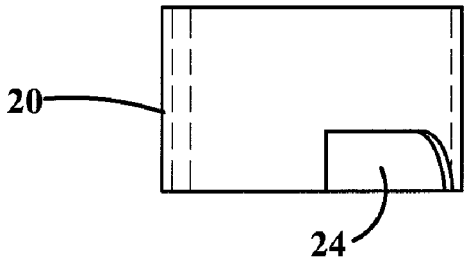
FIGS. 4A and 4B are side views respectively of embodiments of a cover member for a pump system indicating first and second embodiments of a notch, in accordance with the present invention.
Figure 4B:
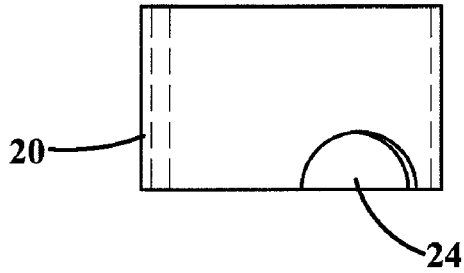

As generally indicated at FIGS. 1A, 1B, 2A, and 2B, and specifically shown in FIGS. 4A and 4B, the cover member 20 preferably includes a notch 24 that engages a periphery of the spray nozzle 16 and defines a passage therethrough. Since the cover member 20 is not sealed onto the pump housing 14, the notch 24 and the pump housing recess 14*a* are in fluid communication, thereby allowing air to freely enter into the breather hole 18. Circulating air must pass between the cover member 20 and the pump housing 14 into the recess 14*a*, and thereby defines the tortuous path that admits circulating air but traps water from entering the breather hole 18.

As shown in FIG. 4A, the notch 24 can be generally rectangular in shape, so as to allow an aperture with space along the sides of the spray nozzle 16 to admit more circulating air. However, a tradeoff would be involved since a larger aperture would also increase the risk of water entering the recess 14*a*, which might in turn enter the breather hole 18. Therefore, it might be advantageous to use a notch 24 having an aperture with a circular sectional shape, as shown in FIG. 4B, which more closely conforms to the shape of the spray nozzle 16, and thereby has reduced fluid communication for both circulating air and moisture. It should be appreciated that either of the aforementioned notch types could alternately be used with the cover member embodiments as shown in FIGS. 3A and 3B.

The cover member 20 in accordance with the present invention can be formed of any suitable material. Preferably, the cover member 20 is made of either a metal, an alloy, or an organic polymer, or a combination thereof. The organic polymer can be selected from the group consisting of polyolefin, polyethylene, polypropylene, fluorinated polyolefin, perfluorinated polyolefin, and any combination thereof, as would occur to one having skill in the art.

The embodiments have been described, hereinabove. It will be apparent to those skilled in the art that the above methods and apparatuses may incorporate changes and modifications without departing from the general scope of this invention. It is intended to include all such modifications and alterations insofar as they come within the scope of the appended claims or the equivalents thereof.

We claim:

1. A fluid pump assembly for performing in a damp environment comprising:

a pump member that drives a quantity of fluid;

a pump housing that encloses the pump member, and comprising a breather hole for circulating cooling air around the pump member during operation;

a cover that substantially covers the breather hole and defines a tortuous path that enables air to circulate through the breather hole while preventing entry of water thereto; and, wherein the pump housing is generally cylindrical and wherein the breather hole lies along a cylindrical surface of the pump housing;

wherein the cover is substantially arcuate and fits around an exterior portion of the generally cylindrical pump housing;

wherein the substantially arcuate cover defines an arc of less than 360 degrees;

a spray nozzle that extends from the pump member; and wherein the cover comprises a notch that engages a periphery of the spray nozzle and defines a passage therethrough, wherein the notch and the pump housing recess are in fluid communication, so as to define the tortuous path.

2. The fluid pump assembly of claim 1, wherein the cover comprises an interior mating surface in engagement with an exterior mating surface on the pump housing, wherein at least a portion of the interior and exterior mating surfaces are substantially spaced so as to define the tortuous path that enables air to circulate through the breather hole while preventing entry of water thereto.

3. The fluid pump assembly of claim 2, wherein the exterior surface of the pump housing comprises a recess that is substantially spaced from the interior mating surface of the cover, so as to define the tortuous path.

4. The fluid pump assembly of claim 3, wherein the recess is substantially annular and defines a tapered portion of the exterior surface of the pump housing.

5. The fluid pump assembly of claim 1, wherein the fluid pump assembly is a component in a vehicle window washer system.

6. A vehicle window washer system comprising:

a pump member that drives a quantity of washer fluid from a fluid reservoir;

a spray nozzle that extends from the pump member and directs pumped washer fluid toward a window;

a generally cylindrical pump housing that encloses the pump member, and comprising a breather hole for circulating cooling air around the pump member during operation;

a generally cylindrical cover member that substantially surrounds at least a portion of the pump housing so as to substantially cover the breather hole, wherein at least a portion of the cover member and the pump housing are substantially spaced so as to define a tortuous path that enables air to circulate through the breather hole while preventing entry of water thereto;

wherein the cover member subtends an arc of less than 360 degrees around the pump housing, having spaced-apart open ends; and wherein the cover member comprises a notch that engages a periphery of the spray nozzle and defines a passage therethrough, wherein the notch and the pump housing recess are in fluid communication, so as to define the tortuous path.

7. The vehicle window washer system of claim 6, wherein the pump housing comprises a recess that is substantially spaced from an interior surface of the cover member, so as to define the tortuous path.

8. The vehicle window washer system of claim 7, wherein the recess is substantially annular and defines a tapered portion of the pump housing.

9. The vehicle window washer system of claim 6, wherein the cover member comprises a material selected from a group comprising at least one of a metal, an alloy, and an organic polymer.

10. The vehicle window washer system of claim 6, wherein the pump housing has an outer diameter that is less than an inner diameter of the cover member.

* * * * *